US011927119B2

(12) United States Patent
Klosterberg et al.

(10) Patent No.: US 11,927,119 B2
(45) Date of Patent: Mar. 12, 2024

(54) OIL RETURN VALVE FOR A CRANKCASE VENTILATION SYSTEM

(71) Applicant: DEUTZ Aktiengesellschaft, Cologne (DE)

(72) Inventors: Johannes Klosterberg, Swisttal (DE); Marco Sliwa, Siegburg (DE); Thomas Werner, Cologne (DE)

(73) Assignee: Deutz Aktiengesellschaft, Cologne (DE)

( * ) Notice: Subject to any disclaimer, the term of this patent is extended or adjusted under 35 U.S.C. 154(b) by 43 days.

(21) Appl. No.: 17/619,000

(22) PCT Filed: May 13, 2020

(86) PCT No.: PCT/EP2020/000095
§ 371 (c)(1),
(2) Date: Dec. 14, 2021

(87) PCT Pub. No.: WO2020/253979
PCT Pub. Date: Dec. 24, 2020

(65) Prior Publication Data

US 2022/0397046 A1 Dec. 15, 2022

(30) Foreign Application Priority Data

Jun. 19, 2019 (DE) ..... 102019004377.4

(51) Int. Cl.
*F01M 13/04* (2006.01)
*F01M 13/00* (2006.01)

(52) U.S. Cl.
CPC ..... *F01M 13/04* (2013.01); *F01M 2013/0044* (2013.01); *F01M 2013/0494* (2013.01)

(58) Field of Classification Search
CPC ..... F01M 13/04; F01M 2013/0044; F01M 2013/0494; F01M 2013/0488; F01M 13/00
See application file for complete search history.

(56) References Cited

U.S. PATENT DOCUMENTS

| | | | | |
|---|---|---|---|---|
| 11,280,233 | B2 * | 3/2022 | Isoshima | F01M 13/0416 |
| 2004/0159314 | A1 * | 8/2004 | Ishizuka | F02M 25/06 123/572 |
| 2009/0211851 | A1 | 8/2009 | Fontaine et al. | |
| 2014/0373797 | A1 | 12/2014 | Brand et al. | |
| 2016/0265404 | A1 * | 9/2016 | Fujii | F01M 13/04 |
| 2017/0362975 | A1 * | 12/2017 | Konishi | F02F 1/36 |

FOREIGN PATENT DOCUMENTS

| | | | |
|---|---|---|---|
| CN | 202900372 | U | 4/2013 |
| CN | 205532772 | U | 8/2016 |
| DE | 1403999 | A1 | 11/1968 |

(Continued)

OTHER PUBLICATIONS

International Search Report for PCT/EP2020/000084, dated Aug. 11, 2020.

*Primary Examiner* — Kurt Philip Liethen
(74) *Attorney, Agent, or Firm* — Davidson, Davidson & Kappel, LLC

(57) ABSTRACT

An oil return valve for a crankcase ventilation system of an internal combustion engine is provided that is essentially situated in the crankcase (3) and includes a valve cylinder (1) and at least one valve pipe (2).

11 Claims, 3 Drawing Sheets

(56) References Cited

FOREIGN PATENT DOCUMENTS

| | | | |
|---|---|---|---|
| DE | 3938919 | | 12/1990 |
| DE | 4420066 | C1 | 7/1995 |
| DE | 19632931 | | 2/1998 |
| DE | 202007011585 | U1 | 10/2007 |
| DE | 102006029681 | A1 | 1/2008 |
| DE | 102010027783 | | 10/2011 |
| DE | 102011008537 | | 7/2012 |
| DE | 102013212104 | A1 | 1/2015 |
| DE | 102013012786 | | 2/2015 |
| EP | 3009620 | | 4/2016 |
| FR | 2868468 | A1 | 10/2005 |
| GB | 1135037 | A | 11/1968 |
| JP | H09236054 | | 9/1997 |
| JP | 2000-087720 | | 3/2000 |
| JP | 2001234725 | A | 8/2001 |
| JP | 2009-293499 | | 12/2009 |

* cited by examiner

OIL RETURN VALVE FOR A CRANKCASE VENTILATION SYSTEM

The present disclosure relates to an oil return valve for a crankcase ventilation system of an internal combustion engine, in particular a hydrostatic oil return valve.

BACKGROUND

Oil return valves of this type are known from DE 202007011585 U1.

A further method for feeding back oil deposited in the exhaust filter of a pump into the oil container of a pump is provided in DE 1403999 A1.

A check valve for an oil circuit in the crankcase ventilation is shown in DE 102013212104 A1.

The return oil of the oil separated by the oil separator generally requires a valve core to prevent blow-by gas from the inside of the crankcase from entering the return line. This valve mechanism may be structurally implemented with the aid of a line profile designed as a siphon at the end of the return line, ball check valves or diaphragm valves, and other specific embodiments. The above-mentioned variants have the following disadvantages with regard to the novel approach:

Line end including a siphon: to implement the siphon, in known approaches a U-shaped line end is used or the downspout ends in a pot-shaped container. The known specific embodiments require a relatively large amount of space inside the crankcase.

Ball check valve: it is possible that the ball jams due to sooting.

Diaphragm valve: the diaphragm made of elastomer is sensitive to high oil temperatures and aggressive media in the oil. The risk of damaging the diaphragm when inserting the valve body and when installing the valve in the crankcase is high. The seat of the diaphragm furthermore requires a high quality surface, thus resulting in increased costs.

The disadvantage here is that the above-described variants are bulky and expensive.

SUMMARY OF THE DISCLOSURE

It is an object of the present disclosure to provide an oil return valve for a crankcase ventilation system that represents a variant for an internal combustion engine that is optimized in terms of installation space and is cost-effective.

The present disclosure provides an oil return valve for a crankcase ventilation system of an internal combustion engine that is essentially situated in the crankcase, including a valve cylinder and at least one valve pipe. The novel approach provides a hydrostatic oil return valve including corresponding installation and functional bores that are inserted into the crankcase (KG), the cylinder crankcase, the cylinder head and/or other components, it being advantageous in this case that it may be implemented cost-effectively and in an optimized manner in terms of installation space.

BRIEF DESCRIPTION OF THE DRAWINGS

Further advantageous embodiments of the present disclosure may be derived from the description of the drawing, in which the exemplary embodiments illustrated in the figures are described in greater detail.

DETAILED DESCRIPTION

Figure 2:
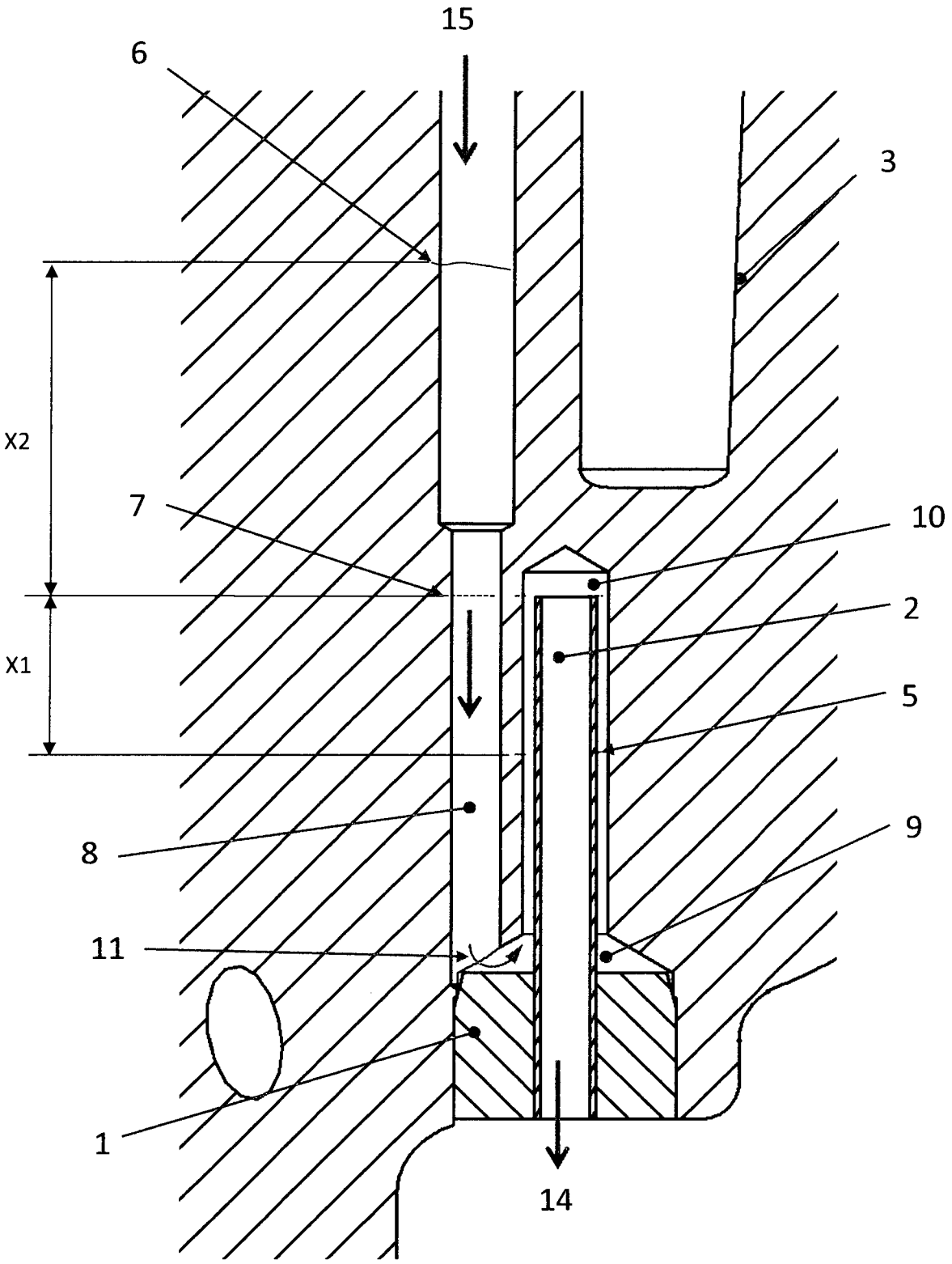
FIG. 2: shows the valve core shown in FIG. 1*a* in an installed state in the crankcase.

The principle here is the siphon principle (see FIG. 2). Here, the pressure difference above the liquid level of a first chamber, formed by the annular gap of bore 10 and valve pipe 2, brings about a shift in the liquid level in the siphon area from its zero level according to the laws of hydrostatics with regard to the liquid level of a second chamber, formed from bore 8. In the case contemplated here—the pressure in the crankcase KG is greater than in the oil separator —, the pressure difference effectuates a drop in the oil level in the first chamber, the oil level drops by X1. In the second chamber, however, the oil level increases by X2. The liquid in the first chamber prevents the gas from the crankcase from entering the oil separator return for exactly as long as the liquid level in the first chamber does not fall below the dividing wall passage. The limiting pressure, at which a gas transfer takes place, may be easily computed using height x=x1+x2 of the liquid column in the previously described limit case.

The special characteristic of the novel approach is initially the simple manner, in which the first chamber and the second chamber are structurally formed. Here, it is differentiated in the following between a standing arrangement of the valve core and a suspended arrangement. FIG. 2 shows the standing arrangement, such as the one installed in crankcase 3. Here, the second chamber is formed as part of oil return bore 8 in crankcase 3. This bore ends in a counter bore 9 that assumes the task of the valve seat. Bore 10 is processed centrically to bore 9. Both bores 9 and 10 thus form a stepped bore. A valve core is inserted into the latter according to FIG. 1*a*, valve pipe 2 forming an annular chamber, which thus represents the first chamber of the siphon, in combination with the bore walls of bore 10. The siphon is completed via valve cylinder 1. Bore 8 forms the second chamber of the siphon.

Figure 3:
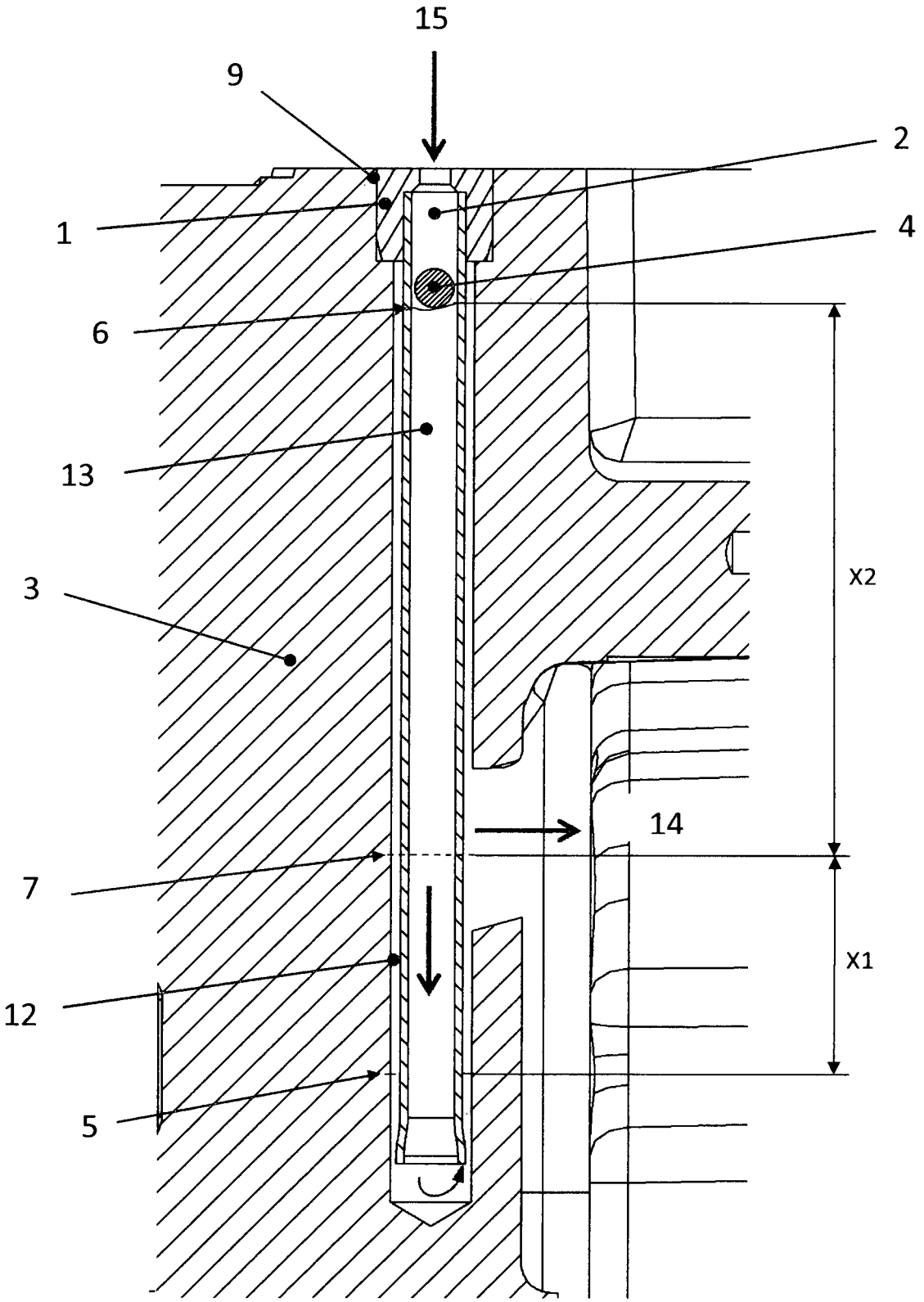
FIG. 3: shows the valve core shown in FIG. 1*b* in an installed state.

FIG. 3 shows the installation case of the valve core situated in a suspended manner. Here, the valve core is pounded from above into a bore in crankcase 3. The annular gap between valve pipe 2 and bore 12 once again form the first chamber that is connected to crank chamber 14 through a lateral opening. The second chamber, into which the deposited oil from the oil separator is supplied from above, is formed by the hollow space in valve pipe 2. In valve pipe 2, a ball is situated, the ball floating on oil level 6 and serving as valve 4.

Figure 1:
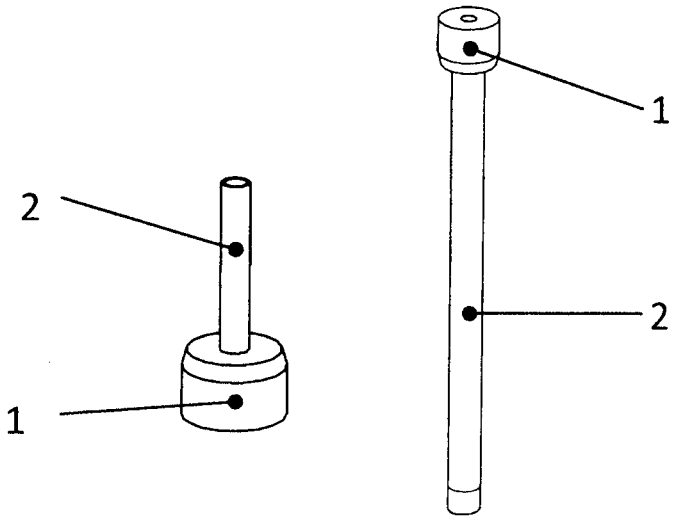
FIG. 1*a*: shows a valve core standing.
FIG. 1*b*: shows a valve core suspended.

The particularly simple installation of the valve core according to FIGS. 1*a* and 1*b* is the second characteristic of the novel approach. Cylindrical valve cylinder 1 may be manufactured cost-effectively from round rod material and inserted into a bore. Valve pipe 2 is manufactured by cutting rod material to length and subsequently connecting it to valve cylinder 1 by pressing, gluing or soldering. The fastening in bore 9 (FIG. 2 and FIG. 3) takes place by press fitting or gluing in. A second possibility would be the use of a screw plug for valve cylinder 1, into which valve pipe 2 is inserted after a bore was established. The fastening then takes place by screwing in. In the event of an error, to prevent a blow-by into the oil separator in the case of excessive overpressure in crankcase 3, a ball or diaphragm valve may be optionally additionally inserted in valve cylinder 1 or valve pipe 2. In FIG. 3, a ball 4 is used as the valve body in valve pipe 2 by way of example.

LIST OF REFERENCE NUMERALS

1 valve cylinder
2 valve pipe
3 crankcase
4 ball
5 oil level 1
6 oil level 2
7 zero level
8 bore in the second chamber
9 bore
10 bore in the first chamber
11 dividing wall passage
12 bore
13 the second chamber in FIG. 3
14 return to crankcase (KG) or to crank chamber
15 intake from oil separator

What is claimed is:

1. An oil return valve for a crankcase ventilation system of an internal combustion engine, the oil return valve being arranged in a crankcase of the internal combustion engine and comprising:

a first bore in the crankcase;

a second bore in the crankcase;

wherein the first bore and the second bore jointly form a stepped bore; and a third bore in the crankcase;

wherein the third bore ends in the second bore;

wherein a longitudinal axis of the first bore and a longitudinal axis of the third bore are spaced from each other;

a valve cylinder which is inserted in the second bore and completes the oil return valve; and a valve pipe arranged in the first bore such that an annular chamber is formed between the valve pipe and a bore wall of the first bore.

2. The oil return valve as recited in claim 1, further comprising an intake from an oil separator.

3. The oil return valve as recited in claim 1, further comprising a return into a crankcase and/or into a crank chamber.

4. The oil return valve as recited in claim 1, wherein the valve pipe is situated centrically in the valve cylinder.

5. The oil return valve as recited in claim 1, wherein the valve pipe has a ball as a valve body.

6. The oil return valve as recited in claim 1, wherein the valve pipe is situated in the first bore, which is integrated in the crankcase, in such a way that an annular gap for receiving the returning oil results.

7. The oil return valve as recited in claim 1, wherein the valve pipe includes at least one diaphragm valve.

8. An assembly comprising:

a crankcase including a first bore in the crankcase; and a second bore in the crankcase;

wherein the first bore and the second bore jointly form a stepped bore; and a third bore in the crankcase;

wherein the third bore ends in the second bore;

wherein a longitudinal axis of the first bore and a longitudinal axis of the third bore are spaced from each other;

an oil return valve comprising a valve cylinder and a valve pipe, the valve cylinder being fixed to the crankcase, the valve pipe extending within the first bore and forming an annular gap between an inner circumference of the first bore and outer circumference of the valve pipe.

9. The assembly as recited in claim 8 wherein an end opening of the valve pipe faces an end of the first bore.

10. The assembly as recited in claim 9 wherein the valve pipe is configured for fluid to flow through the end opening into the annular gap and/or from the annular gap into the end opening.

11. The assembly as recited in claim 8 further comprising an oil separator intake, the oil return valve fluidly connected to the oil separator intake.

* * * * *